US005549482A

United States Patent [19]

Langlais et al.

[11] Patent Number: 5,549,482

[45] Date of Patent: Aug. 27, 1996

[54] APPARATUS FOR SECURING TOGETHER AN ATTACHMENT PLUG WITH AN ELECTRIC RECEPTACLE

[76] Inventors: Daniel Langlais, 431 Principale, St-Prime, Québec, Canada, G0W 2W0; Gervais Archambault, 35 Avenue de la Fabrique, Ste-Hedwidge, Québec, Canada, G0W 2R0

[21] Appl. No.: 361,972

[22] Filed: Dec. 22, 1994

[30] Foreign Application Priority Data

Apr. 26, 1994 [GB] United Kingdom ..... 9408243

[51] Int. Cl.[6] ..... H01R 13/62

[52] U.S. Cl. ..... 439/369; 439/373; 439/451

[58] Field of Search ..... 439/368, 369, 439/371, 373, 449, 451

[56] References Cited

U.S. PATENT DOCUMENTS

| | | | |
|---|---|---|---|
| 2,720,633 | 10/1955 | Westberg . | |
| 3,275,969 | 9/1966 | Sheeran . | |
| 3,838,383 | 9/1974 | Wilbur et al. . | |
| 3,960,432 | 6/1976 | Wilbur . | |
| 4,206,961 | 6/1980 | Cifalde . | |
| 4,504,106 | 3/1985 | Fechter . | |
| 4,596,430 | 6/1986 | Olson . | |
| 4,610,494 | 9/1986 | Schauber . | |
| 4,704,500 | 11/1987 | Shimirak et al. | 174/93 |
| 4,768,974 | 9/1988 | Cowan et al. | 439/371 |
| 4,773,874 | 9/1988 | Kopeski, Jr. | 439/369 |
| 4,884,979 | 12/1989 | Budner | 439/369 |
| 4,917,626 | 4/1990 | Barton | 439/369 |
| 4,925,399 | 5/1990 | Bosworth et al. | 439/370 |
| 5,104,335 | 4/1992 | Conley et al. | 439/369 |
| 5,110,303 | 5/1992 | Hardy | 439/367 |
| 5,133,671 | 7/1992 | Boghosian | 439/371 |
| 5,179,044 | 1/1993 | Muromachi et al. | 439/369 |
| 5,211,573 | 5/1993 | Cross | 439/369 |

FOREIGN PATENT DOCUMENTS

| | | |
|---|---|---|
| 978619 | 11/1975 | Canada . |
| 1076671 | 4/1980 | Canada . |
| 2003280 | 11/1989 | Canada . |
| 2013426 | 3/1990 | Canada . |

*Primary Examiner*—Khiem Nguyen

*Attorney, Agent, or Firm*—Ware, Fressola, Van Der Sluys & Adolphson

[57] ABSTRACT

An apparatus for securing together an attachment plug mounted at one end of an electric flexible cord, with an electric receptacle defining either a cord connector or an electric wall receptacle is disclosed. The apparatus comprises in combination an elongated member fastened to a buckle in which an arcuated portion of the electric flexible cord is mounted and blocked. The free end of the elongated member is then secured to an anchoring object which is the electric wall receptacle if the apparatus is securing the attachment plug with the wall receptacle. If the apparatus is securing extension cords together, the anchoring object is another buckle in which the electric cord of the cord connector is mounted and blocked. This securing apparatus is very advantageous because it is equally suitable for securing a coupled pair of electrical cords to one another or, in the alternative, for securing attachment plug in a standard wall receptacle. It is also easy to install and low in cost.

14 Claims, 4 Drawing Sheets

APPARATUS FOR SECURING TOGETHER AN ATTACHMENT PLUG WITH AN ELECTRIC RECEPTACLE

FIELD OF THE INVENTION

The present invention relates to an apparatus for securing together an attachment plug mounted at one end of an electric cord with an electric receptacle defining either a cord connector or an electric wall.

BACKGROUND OF THE INVENTION

Electrical appliances or extension cord are used everywhere, in household, office or in any building. Often by accident, the electric contacting devices of these appliances or extension cords, just detach from each other. Over the years, many types of devices have been developed for securing or retaining together these contacting devices. Typically, these devices may be divided in two groups, the first group being adapted to lock together a plug on the end of an extension cord with a plug receptacle or socket on the end of another extension cord. Devices of this type are described, by way of examples, in U.S. Pat. Nos. 4,206,961; 4,504,106; 4,773,874 and 4,884,979. The second group describes devices provided to secured a plug with an electric wall receptacle and examples of this type of device are found, in U.S. Pat. Nos. 3,838,383; 3,960,432 and 4,768,974. As can be easily understood each of these devices are provided to restrictively secure only one type of electric connecting devices, either a plug with an electric wall receptacle or two extension cord secured together.

There is a need presently for an electric cord connector which may be suitable for securing a coupled pair of electrical cords to one another or, in the alternative, for securing an electrical cord plug in a standard wall receptacle. There is also a need for an electric cord connector of this type which is easy to install and which is low in cost.

SUMMARY OF THE INVENTION

An object of the present invention is to provide an apparatus for securing together an attachment plug with an electric receptacle that satisfies these above needs.

More particularly, the object of the present invention is to provide an apparatus for securing together an attachment plug mounted at one end of an electric flexible cord, with an electric receptacle defining either a cord connector or an electric wall receptacle. This apparatus comprises in combination, a member having opposite ends and a buckle comprising a frame and tongue that are movable one with respect to the other. The frame is provided with an opening for receiving an arcuated portion of the electric flexible cord such that the arcuated portion of the cord is extendable over the frame. The tongue is removably connectable above the opening to be engaged by the arcuated portion of the electric flexible cord, and is pressed against the frame when the arcuated portion of the cord is moved backwardly across the opening to thus prevent the cord to be removed from the opening. The buckle is fastenable to one of the opposite ends of the member. The apparatus also comprises means for securing the other opposite end of the member to an anchoring object.

According to a preferred embodiment, the anchoring object is the electric receptacle defining an electric wall receptacle. Preferably, in this embodiment, the frame has opposite sides and the tongue has two extremities. One of the extremity is pivotally connected to one of the opposite sides and the opposite end of the member fastened to the buckle is fastened to the frame of the buckle.

According to another preferred embodiment where the apparatus is securing an attachment plug to a cord connector mounted at one end of another flexible cord, the anchoring object may be another buckle having also a frame and a tongue that are movable one with respect to the other. The frame of this other buckle is also provided with an opening for receiving an arcuated portion of the other electric flexible cord such that the arcuated portion of the other electric cord is extendable over the frame. The tongue is also removably connectable above the opening to be engaged by the arcuated portion of the other electric flexible cord, and is pressed against the frame when the arcuated portion of the cord is moved backwardly across the opening to thus prevent the cord to be removed from the opening.

Preferably, in this other preferred embodiment, the frame of each buckles has opposite sides and the tongue of each buckles has two extremities. For each buckle one of the extremity is pivotally connected to one of the opposite sides of the frames. Also, the opposite ends of the member fastenable to the buckles are fastened to the frame of each buckle.

For each of these preferred embodiments, the apparatus may further comprises locking means for locking the other extremity of the tongue to the other opposite side of the frame and all the elements of the apparatus may be integral to each other and made of plastic material.

A non restrictive description of preferred embodiments will now be given with reference to the appended drawings.

DESCRIPTION OF PREFERRED EMBODIMENTS

Figure 1:
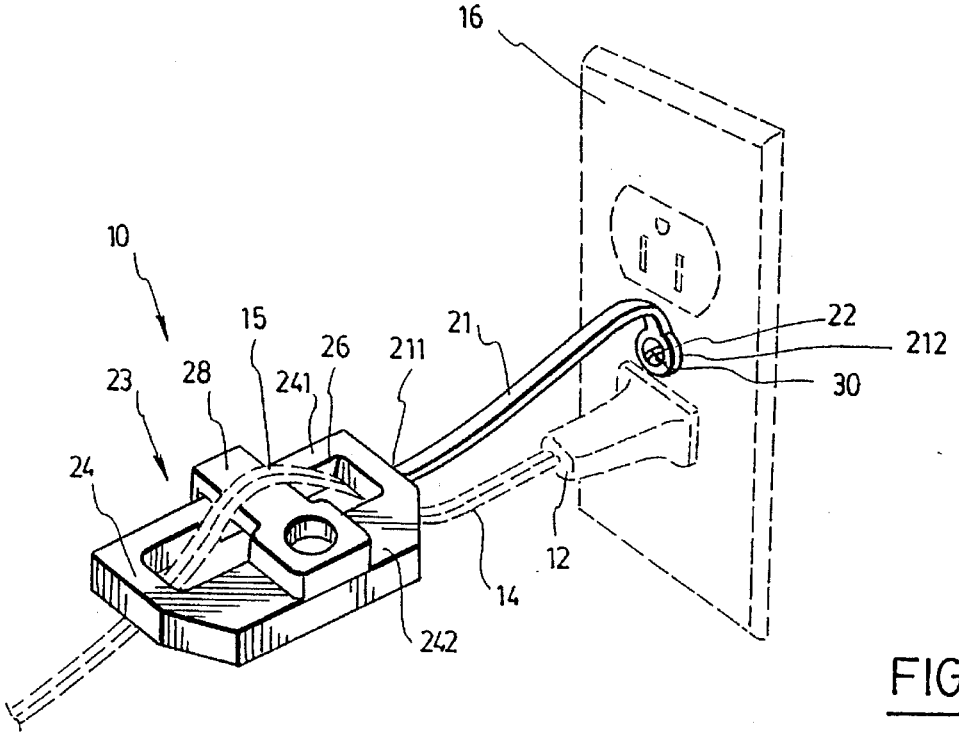
FIG. 1 is a perspective view of an apparatus for securing an attachment plug with an electrical wall receptacle according to a preferred embodiment of the present invention.
Figure 3:
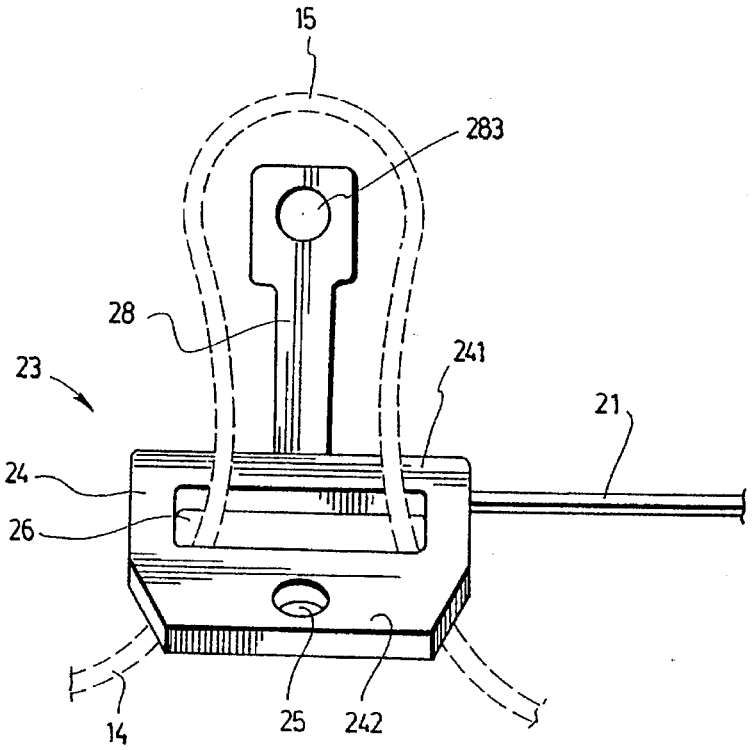
FIG. 3 is a partial view of either the apparatus of FIG. 1 or 2, showing an electric flexible cord passed through the opening of the frame in order to connect the tongue above the opening.
Figure 4:
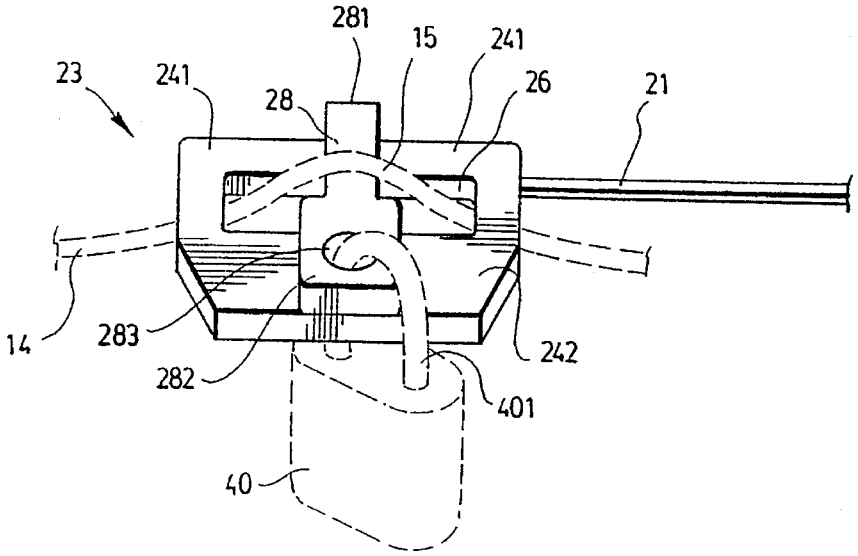
FIG. 4 is the same view of FIG. 3 showing the arcuate portion of the flexible cord engaging the tongue and also showing the tongue being pressed against the frame to prevent the cord to be removed from the opening and being locked with a padlock.

Referring to FIG. 1 is an apparatus 10, according to a first preferred embodiment of the present invention, for securing together an attachment plug 12 with an electric wall receptacle 16. The attachment plug 12 is conventionally mounted at one end of an electric flexible cord 14. As illustrated, this apparatus 10 comprises a buckle 23 fastened to one opposite end 211 of a preferably elongated member 21. The buckle and the member which are integral to each other may be made of plastic material. Of course, another material may be used such as a rubber or metallic material. As illustrated, the buckle 23 comprises a frame 24 and a tongue 28 that are movable one with respect to the other. The frame 24 has at least two opposite sides 241, 242 and is provided with an opening 26. One extremity 281 of the tongue 28 may be pivotally connected to one side 241 of the frame 24 so that the other extremity 282 can be moved between two positions, as illustrated in FIGS. 3 and 4. In use, as illustrated in FIG. 3, an arcuated portion 15 of the electric flexible cord 14 on which the attachment plug 12 to be secured is first passed through the opening 26 so that it is extending over the frame. The tongue 28 is then passed under this arcuate portion 15 of the cord 14 which is then moved backwardly across the opening 26. As illustrated in FIG. 4, the tongue 28 is then engaged by the cord 14 and pressed against the frame 24 such that cord 14 can not be removed from the opening 26.

As described hereinbefore one end 211 of the member 21 is fastened to the buckle, and preferably, as illustrated in FIG. 1, it is fastened to one side of the frame 24. The other free end 212 of the member 21 has to be secured to an anchoring object which is the electric wall receptacle 16 in the preferred embodiment shown in FIG. 1. In this embodiment, the free end 212 of the member 21 is provided with a hole 22 in which a screw 30 is inserted so that the member 22 may be secured to the wall receptacle 16. Of course, with reference to the knowledge of a person skilled in the art, any other securing means allowing the free end 212 of the member 21 to be fixed or secured to the wall receptacle may also be conceived.

Figure 2:
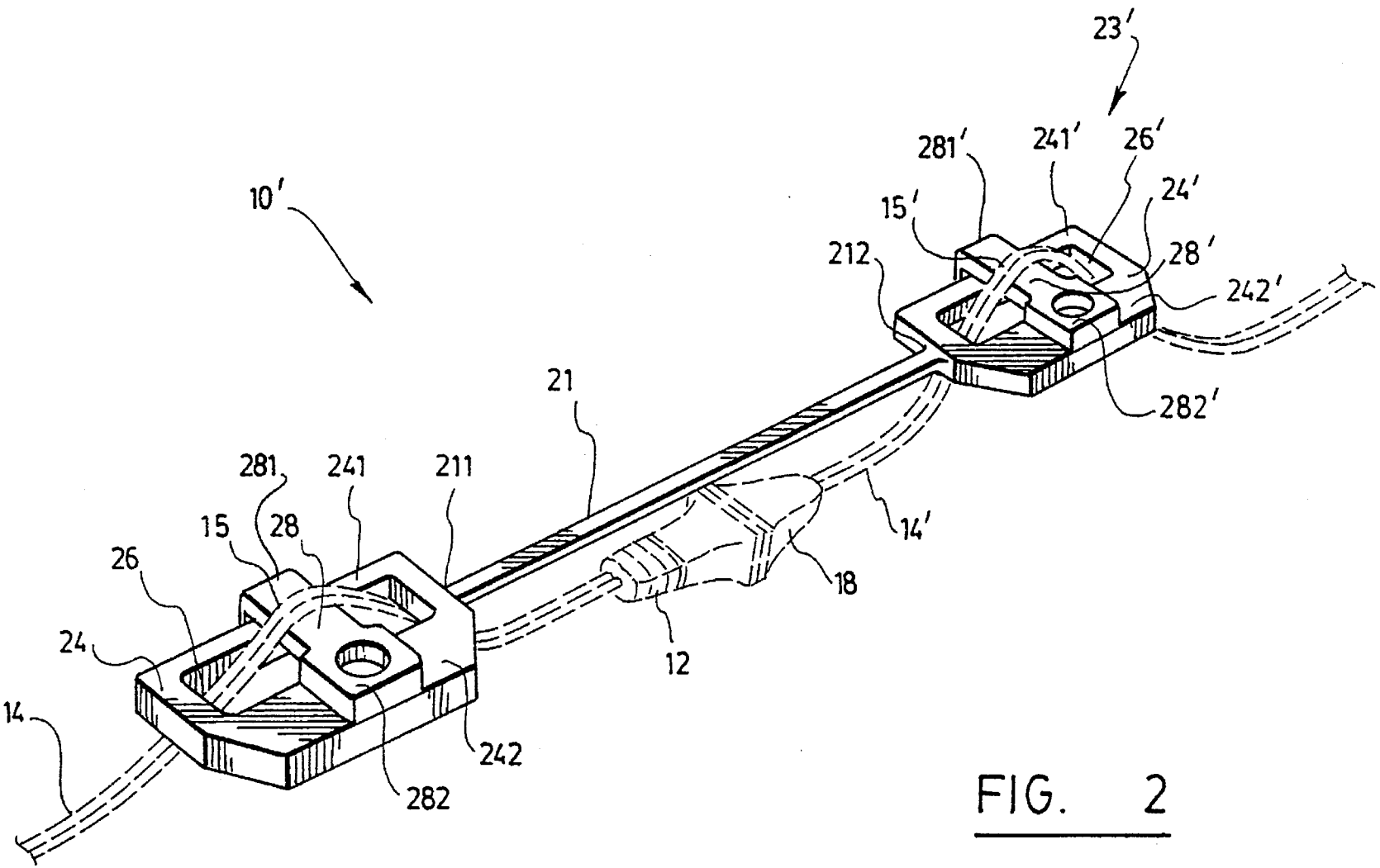
FIG. 2 is a perspective view of an apparatus for securing an attachment plug with a cord connector according to another preferred embodiment of the present invention.

Referring now to FIG. 2, there is illustrated an apparatus 10' according to a second preferred embodiment of the present invention, for securing an attachment plug 12' to a cord connector 18 mounted at the end of an electric cord 14'. This second embodiment is mainly useful for securing together a plug attachment of an electric cord set, also called extension cable, to the receptacle (such as a plug conversion) of another electric cord set. As illustrated in FIG. 2, this embodiment comprises the same elements as the first embodiment described hereinbefore except that, in this case, the anchoring object on which the elongated member 21 is secured is a second buckle 23' which is preferably of the same type as the one described hereinbefore. The member 21 may advantageously be provided with a hole (not illustrated). When this member is cut in the vicinity of said hole, the apparatus 10' may be transformed into an apparatus 10 as illustrated in FIG. 1. The apparatus 10 may then be used for securing together an attachment plug with an electric wall receptacle. In use, an arcuated portion 15 of the electric cord 14 connected to the attachment plug 12 is mounted into the first buckle 23 in the same way as just described for the first embodiment. Then, in the same manner, an arcuated portion 15' of the electric cord 14' connected to the cord connector 18 is mounted and blocked in the second buckle 23'. The attachment plug 12 and the cord connector 18 are then secured together.

Figure 5:
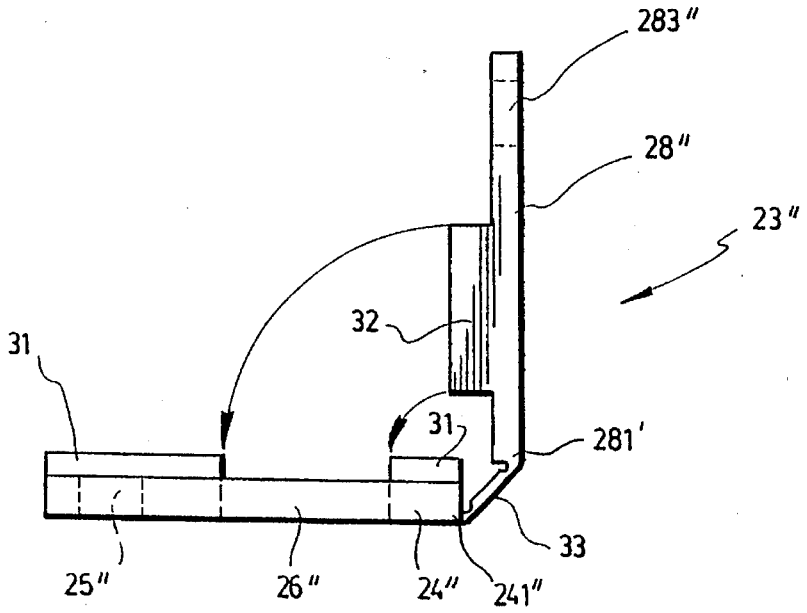
FIG. 5 is a side elevational view of an apparatus according to another preferred embodiment of the present invention showing guiding fins provided on the frame.
Figure 6:
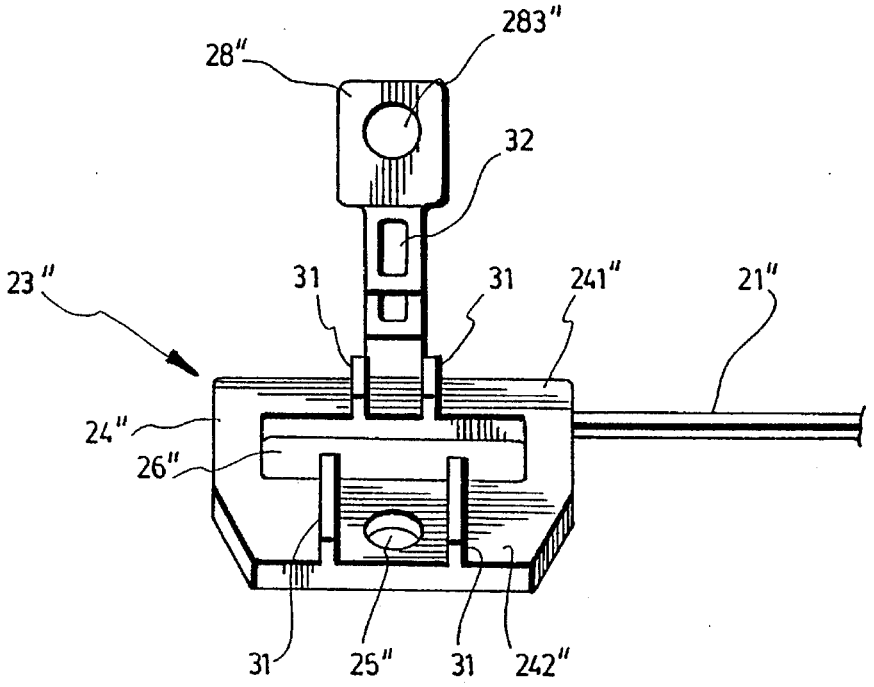
FIG. 6 is a perspective view of the apparatus shown in FIG. 5.

Advantageously, and particularly for thin electric cords as illustrated in FIG. 4, the apparatus may also comprises a lock 40 for locking the free end 282 of the tongue 28 onto the frame 24 when it is pressed against the same. More particularly, the free end 282 and the frame 24 are respectively provided with a bore 283, 25 adapted to be engaged by the bolt 401 of the lock 40. Any kind of lock such as padlock or clip may be used. Of course, if desired, the free end 282' of the tongue 28' comprises in the second buckle 23' may be locked in the same way. In another preferred embodiment illustrated in FIGS. 5 and 6, in which the frame 24" and the tongue 28" are well adjusted, the frame 24" is provided with parallel guiding fins 31 adapted to receive the tongue 28" in a close-fitting manner. The tongue 28" may be also provided with a protuberance 32 shaped to fit closely into the opening 26" of the frame 24". In this embodiment, the tongue 28" is pivotally connected to the frame 24" by means of a thin plastic strip 33 linking up the end of the tongue 281" together with an opposite side 41" of the frame 24".

Figure 7:
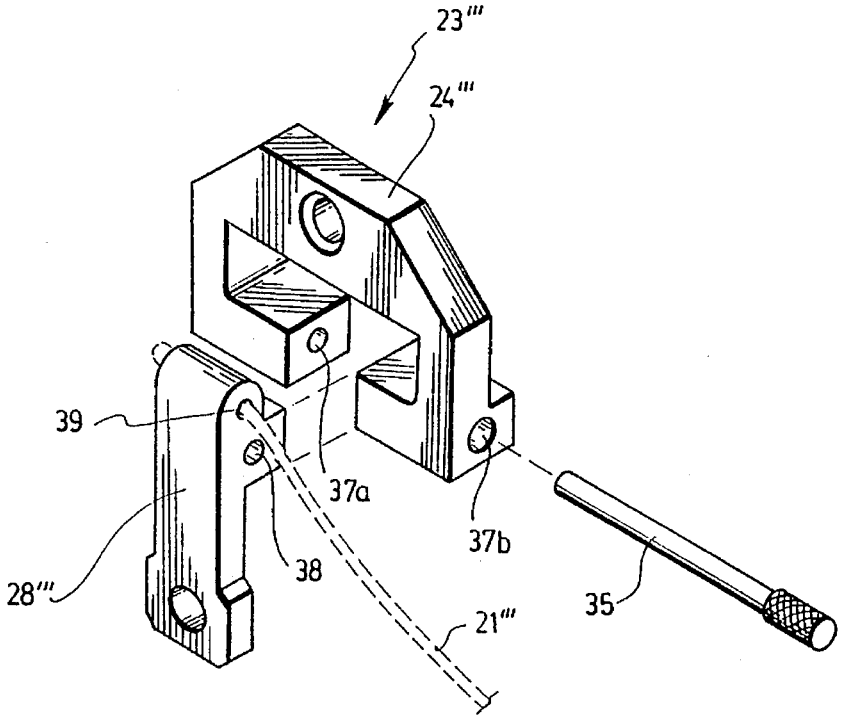
FIG. 7 is an exploded view showing only one buckle of another preferred embodiment of the present invention.

Referring now to FIG. 7, there is illustrated a buckle 23''' comprised in another preferred embodiment of the present invention, preferably made of metallic material. This buckle 23''' comprises a substantially U-shaped frame 24''' and a tongue 28''' which is pivotally mounted onto the frame 24''' by means of a hinged pin 35. As illustrated in FIG. 7, the extremities of the U of the frame are each provided with a bore **37*a*, 37*b* coaxial with each other. In this embodiment, the end of the tongue 28''' connectable to the frame 24''' is also provided with a bore 38. This bore 38 is coaxial with the bores 37*a*,37*b* of the frame when the tongue 28''' is connected to the frame 24''' by means of the hinged pin 35 passing through these bores 37*a*,37*b*,38. As also illustrated in FIG. 7, the end of the tongue 28''' connected to the frame 24''' may further be provided with a hole 39 parallel to the bore 38. This hole may be used for fastening one end of the elongated member (not illustrated) of the apparatus to the frame 23'''**.

The apparatus for securing electric connectors together is thus believed to be very advantageous over prior devices of this type which are generally adapted to secured only one kind of electric connections. The apparatus is also advantageous because it is easy to use and low in cost.

Although preferred embodiments of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. An apparatus for securing together an attachment plug mounted at one end of an electric flexible cord, with an electric receptacle defining either a cord connector or an electric wall receptacle, wherein said apparatus comprises in combination:

a member having opposite ends;

a buckle comprising a frame and tongue that are movable one with respect to the other, the frame being provided with an opening for receiving an arcuated portion of the electric flexible cord such that said arcuated portion is extendable over the frame;

the tongue being removably connectable above the opening to be engaged by the arcuated portion of the electric flexible cord, and being pressed against the frame when the arcuated portion of said cord is moved backwardly across the opening to thus prevent said cord to be removed from said opening;

said buckle being fastenable to one of the opposite ends of the member; and means for securing the other opposite end of the member to an anchoring object.

2. An apparatus as claimed in claim 1, wherein the electric receptacle is defining an electric wall receptacle and said anchoring object is the electric receptacle defining an electric wall receptacle.

3. An apparatus as claimed in claim 1, wherein the electric receptacle is defining a cord connector mounted at the end of another flexible cord and wherein:

the anchoring object comprises:

another buckle having a frame and a tongue that are movable one with respect to the other, said frame being provided with an opening for receiving an arcuated portion of said another electric flexible cord such that said arcuated portion of said another electric flexible cord is extendable over said frame;

said tongue being removably connectable above the opening to be engaged by the arcuated portion of said another electric flexible cord, and being pressed against the frame when the arcuated portion of said cord is moved backwardly across the opening to thus prevent said cord to be removed from said opening.

4. An apparatus as claimed in claim 2, wherein:

the frame has opposite sides and the tongue has two extremities, one of said extremity being pivotally connected to one of said opposite sides; and the opposite end of the member fastenable to the buckle is fastenable to the frame of said buckle.

5. An apparatus as claimed in claim 3, wherein:

the frame of each buckles has opposite sides and the tongue of each buckles has two extremities, for each buckle one of said extremity being pivotally connected to one of said opposite sides; and the opposite end of the member fastenable to the buckle is fastenable to the frame of said buckle and the other opposite end secured to the other buckle is secured to the frame of said other buckle.

6. An apparatus as claimed in claim 4 further comprising locking means for locking the other extremity of the tongue to the other opposite side of the frame.

7. An apparatus as claimed in claim 5 further comprising locking means for locking the other extremity of each tongue to the other corresponding opposite side of each frame.

8. An apparatus as claimed in claim 6 wherein the member and the buckle are integral to each other and made of plastic material.

9. An apparatus as claimed in claim 7 wherein the member and the buckles are integral to each other and made of plastic material.

10. An apparatus as claimed in claim 8, wherein the means for securing the opposite end of the member to the electric wall receptacle comprises screws.

11. An apparatus as claimed in claim 2, further comprising a hinged pin, and wherein:

the frame has substantially the shape of a U having two arms, each extremity of said arms being provided with a bore and each bore being coaxial with each other; and the tongue has two extremities, one of said extremities being pivotally connectable to the frame between said arms of the frame and being provided with a hole such that when the tongue is connected to the frame, said hole is coaxial with said bores and said hinged pin is passing through said bores and hole; and the opposite end of the member fastenable to the buckle is fastenable to the tongue of said buckle.

12. An apparatus as claimed in claim 3, further comprising two hinged pins, and wherein:

the frame of each buckle has substantially the shape of a U having two arms, each extremity of said arms being provided with a bore and each bore being coaxial with each other; and the tongue of each buckle has two extremities, one of said extremities being pivotally connectable to the corresponding frame between said arms and being provided with a hole such that when the tongue is connected to the corresponding frame, said hole is coaxial with said bores of the corresponding frame and one of said hinged pins is passing through said bores and hole; and the opposite end of the member fastenable to the buckle is fastenable to the tongue of said buckle and the other opposite end secured to the other buckle is secured to the tongue of said other buckle.

13. An apparatus for securing together an attachment plug mounted at one end of a first electric flexible cord, with an electric receptacle defining a cord connector mounted at one end of another electric flexible cord, wherein said apparatus comprises in combination:

a member having opposite ends;

two buckles, each buckle comprising a frame having opposite sides and a tongue having two extremities, one of said extremity being pivotally connected to one of said opposite sides;

the frame being provided with an opening for receiving an arcuated portion of the corresponding electric flexible cord such that said arcuated portion of the corresponding electric cord is extendable over the frame; and the tongue being removably positionable above the opening to be engaged by the arcuated portion of the corresponding electric flexible cord, and being pressed against the frame when the arcuated portion of said cord is moved backwardly across the opening to thus prevent said cord to be removed from said opening; and one of said buckle being fastenable to one of said ends of the member and the other buckle being fastenable to the other end of the member.

14. An apparatus for securing together an attachment plug mounted at one end of a first electric flexible cord, with an electric receptacle defining an electric wall receptacle, wherein said apparatus comprises in combination:

a member having opposite ends, one of said ends being provided with a hole;

a buckle comprising a frame having opposite sides and a tongue having two extremities, one of said extremity being pivotally connected to one of said opposite sides;

the frame being provided with an opening for receiving an arcuated portion of the corresponding electric flexible cord such that said arcuated portion of the corresponding electric cord is extendable over the frame; and the tongue being removably positionable above the opening to be engaged by the arcuated portion of the corresponding electric flexible cord, and being pressed against the frame when the arcuated portion of said cord is moved backwardly across the opening to thus prevent said cord to be removed from said opening; and said buckle being fastenable to one of said ends of the member; and at least one screw for securing the end of the member provided with a hole to the electric wall receptacle.

* * * * *